US008737175B2

(12) United States Patent
Bakker

(10) Patent No.: US 8,737,175 B2
(45) Date of Patent: May 27, 2014

(54) CHRONOGRAPH

(76) Inventor: Atte Nicolaas Bakker, Emmen (NL)

( * ) Notice: Subject to any disclaimer, the term of this patent is extended or adjusted under 35 U.S.C. 154(b) by 86 days.

(21) Appl. No.: 13/502,614

(22) PCT Filed: Oct. 28, 2010

(86) PCT No.: PCT/NL2010/000156

§ 371 (c)(1),
(2), (4) Date: Apr. 18, 2012

(87) PCT Pub. No.: WO2011/053123

PCT Pub. Date: May 5, 2011

(65) Prior Publication Data

US 2012/0201103 A1 Aug. 9, 2012

(30) Foreign Application Priority Data

Oct. 29, 2009 (NL) ..... 1037424

(51) Int. Cl.
*G04B 19/00* (2006.01)
*G04F 8/00* (2006.01)

(52) U.S. Cl.
USPC ..... 368/80; 368/110

(58) Field of Classification Search
USPC ..... 368/71, 80, 223, 228, 232, 238, 76–79, 368/110, 69
See application file for complete search history.

(56) References Cited

U.S. PATENT DOCUMENTS 426,396 A * 4/1890 Schlatter ..... 368/102
2,361,563 A * 10/1944 Pellaton ..... 368/80
4,364,669 A 12/1982 Thoenig et al.
5,077,708 A * 12/1991 Schneider ..... 368/107
5,297,121 A * 3/1994 Sepehri ..... 368/228
5,959,941 A * 9/1999 Murakami et al. ..... 368/80
6,275,450 B1 8/2001 Makiba
6,570,823 B1 * 5/2003 Gilomen et al. ..... 368/113
6,842,403 B2 * 1/2005 Meis ..... 368/110
6,975,561 B2 * 12/2005 Forsey et al. ..... 368/10
7,120,093 B2 * 10/2006 Lazaretnik ..... 368/80
7,170,826 B2 * 1/2007 Furukawa et al. ..... 368/80
7,173,883 B2 * 2/2007 Seyr ..... 368/110
7,215,603 B2 * 5/2007 Koike ..... 368/223
7,364,352 B2 * 4/2008 Akahane et al. ..... 368/101
8,050,147 B2 * 11/2011 Campbell ..... 368/80
8,328,413 B2 * 12/2012 Lechot et al. ..... 368/124

(Continued)

FOREIGN PATENT DOCUMENTS

CH 682201 A3 8/1993
CH 684769 A3 12/1994

(Continued)

*Primary Examiner* — Sean Kayes
(74) *Attorney, Agent, or Firm* — Shewchuk IP Services, LLC; Jeffrey D. Shewchuk

(57) ABSTRACT

A chronograph comprises a main dial with coaxially placed main hands group and at least one sub dial, placed within the main dial, with a therein coaxially placed main hands group. The invention is characterized in that at least one sub hands group displays an indication of current time and the main hands group displays an indication of chrono time. A first preferred form of implementation provides that the sub dial is placed decentralized within the main dial. A second preferred form of implementation provides that the sub hands group is placed coaxially with the main dial; the main dial and main hands group are partially covered by the sub dial; and the sub hands group is coaxially with the main hands group.

16 Claims, 1 Drawing Sheet

(56) References Cited

U.S. PATENT DOCUMENTS

| | | | | |
|---|---|---|---|---|
| 8,432,772 | B2 * | 4/2013 | Meis | 368/71 |
| 2004/0170088 | A1 | 9/2004 | Seyr | |
| 2005/0249044 | A1 | 11/2005 | Forsey et al. | |
| 2005/0259520 | A1 | 11/2005 | Forsey et al. | |
| 2006/0164922 | A1 | 7/2006 | Forsey et al. | |
| 2006/0280037 | A1 | 12/2006 | Houlon et al. | |

FOREIGN PATENT DOCUMENTS

| | | | |
|---|---|---|---|
| EP | 0130150 | A1 | 1/1985 |
| EP | 0964320 | A1 | 12/1999 |
| EP | 1408383 | A1 | 4/2004 |
| EP | 1691243 | A2 | 8/2006 |
| EP | 1892590 | A1 | 2/2008 |
| WO | 2005/091086 | A1 | 9/2005 |

* cited by examiner

CHRONOGRAPH

The present invention relates to a chronograph comprising a main dial with a therein coaxially positioned main hands group and at least one separate, within the circumference of the main dial positioned sub dial.

Such a chronograph is commonly known. Almost all watch manufacturers have at least one such a chronograph in their range of products. A similarity between these well-known chronographs is that the display of the current time is displayed on the main dial, which is always bigger than the sub dial. The display of the chrono time is of minor importance. Therefore these chronographs have the disadvantage that the readability of the chrono time is worse than the readability of the current time. When more sub dials are provided, in many cases they display a chrono timekeeping in minutes, hours and sometimes tenths of seconds.

In particular, due to internal conjunction because of the hands of the current time, the readability of the chrono time hands is poor.

Figure 1:
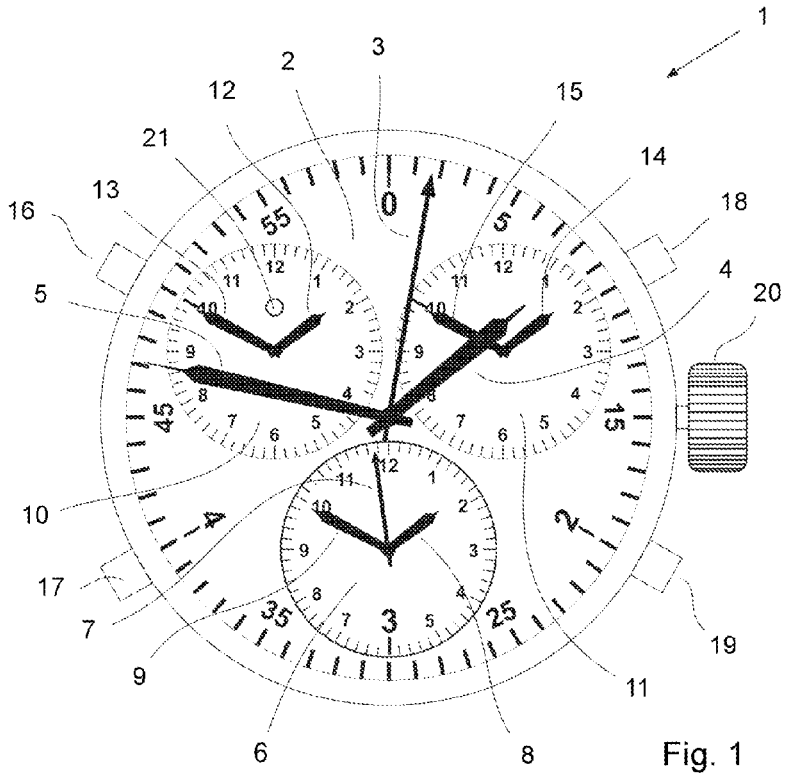
Figure 2:
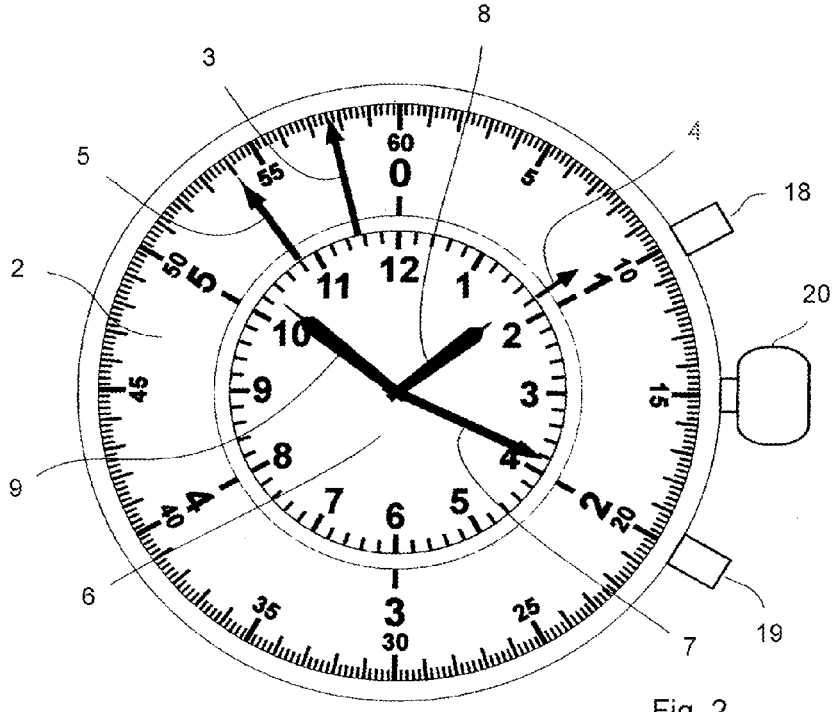

CH 682201 and CH 684769 both show a centrally positioned chrono hands group. A sub hands group that displays the current time is located decentralized within the main dial. In FIG. 2 of CH 682201 and in FIG. 1 of CH 684769 the current time is displayed on a collective sub dial, but the chrono time is divided among three dials.

Publications EP 0130150, EP 1408383 and U.S. Pat. No. 4,364,669 all display a main hands group for the chrono time and a coaxially placed sub hands group for the current time that are placed on a collective dial. In FIG. 1 of EP 0130150 the current time is displayed on a single sub dial but the chrono time is divided among four dials. In FIG. 1 of EP 0408383 the current time is displayed on a single main dial and the chrono time is divided among three dials. In FIG. 1 of U.S. Pat. No. 4,364,669 the current time is displayed on a single main dial and the chrono time is divided among three dials.

WO2005/091086 and EP1691243 show a main dial with main hands group that displays the current time and a sub dial placed within the main dial that displays the chrono time.

The object of the invention is to provide an improved chronograph.

In particular, the invention aims to provide a chronograph with improved readability of the chrono time.

To achieve at least one of the above mentioned aims, the invention provides a chronograph according to the preamble characterized in that at least one sub hands group displays current time and the main hands group indicates a display of chrono time, wherein the main hands group comprises a coaxially positioned chrono second, chrono minute and chrono hour hand. As a result the readability of the chrono time is greatly improved because it is displayed without obstruction at all times. Also the chrono timekeeping makes use of the circumference of the total dial, as a result of which fast, accurate, univocal and easy reading is possible. Unexpectedly it appeared that the clarity of the display of the current time is not affected by a position that is not situated on the main dial.

A particularly clear display is achieved when the sub dial is located decentralized within the main dial. In that case also the sub dial and respective sub hands group are designed smaller than the main dial and respective main hands group. The sub dial is then located between the rotating axis of the main hands group and the outer circumference of the main dial, in such a way that an unhindered rotation of the hands groups is possible.

In particular it is preferred that the chronograph has at least two, preferably three sub dials with respective sub hands groups. Especially it is preferred that the hands groups of the sub dials each have at least two hands. In that case one of them can display a current time as mentioned above, and at least one of the others can display, for example, an alarm time or a second time.

In particular it is preferred that the sub hands group for displaying the current time has a second hand, an hour hand and a minute hand. In this way a complete display of the current time is provided.

According to a further aspect it is preferred that the order of placing of the main hands group is chrono second, chrono hour and chrono minute hand, at which the chrono minute hand is situated closest to the main dial.

By this setup the occurrence of internal conjunction is prevented. The chrono minute hand is longer than the chrono hour hand, as a result of which the chrono hour hand is situated above the longer chrono minute hand at all times.

In a similar way the order of placing of at least one sub hands group for displaying the current time is second, hour and minute hand, at which the minute hand is situated closest to the sub dial. By this setup the occurrence of internal conjunction is prevented.

Also, it has the preference that the main dial comprises an hour scale divided over six hours that is situated along its outline. As a result, reading the chrono hour time can be done more accurate and faster. Also it prevents that a user mistakes the chrono time for the current time.

In particular it is preferred that the sub dial with sub hands group for indication of the current time is situated in a bottom position of the main dial. Especially when the chrono timekeeping is not being used the chrono hands group will be in the top position, as a result of which an obstruction-free reading of the current time is guaranteed.

If, in addition to the sub dial for the current time two other sub dials with respective sub hands groups are provided, these can be paced top left or top right within the main dial. If both possess at least two hands, one of them can display an alarm time (in hours and minutes), the other can display a second time (in hours and minutes). For example, the sub hands groups of one of these two other sub dials can, in the case of a chrono timekeeping, serve as display of tenths and hundreds of a second of the measured chrono time.

To be able to set the functions and displays concerned, the chronograph according to the invention is equipped with control buttons for setting the current time; activating and setting the alarm; initiate, pause, stop and reset the chrono time.

Finally, it is preferred that the chronograph according to the invention comprises an indicator with a first indication for switched off alarm and a second indication for switched on alarm, at which the indicator preferably is provided in the sub dial with sub hands group for indicating an alarm time.

For example, the indicator may include a lighting that is switched on in case of active alarm and switched off in case of inactive alarm, or, preferably, because of the energy consumption of a lighting, comprises an opening in the sub dial under which a, possibly colored, small sliding disc is placed that by means of pressing a button that is provided for that purpose, slides underneath the opening because of an indication of active alarm, or slides from underneath it because of an indication of inactive alarm.

A particular form of implementation is obtained with a chronograph at which:—the sub dial is located concentrically with the main dial;—the main dial and main hands group are partly covered by the sub dial; and—the sub hands group is located coaxially with the main hands group. As a result of which a completely conjunction-free chronograph is obtained. In particular, also in this case it has the preference that the order of setup of the sub hands group for displaying the current time is second, hour and minute hand, at which the minute hand is situated closest to the sub dial.

Finally, it is preferred that the sub hands group for displaying the current time only comprises an hour hand and a minute hand and, as far as the chrono hands group does not display chrono timekeeping, a display of the current second time is provided for by at least one hand of the chrono hands group. As a result a clear time display is provided. Even the effect of a single second hand can be provided when all chrono hands collectively serve as a single second hand.

The invention present will now be explained on the basis of the drawing, in which FIG. 1 shows a schematic reproduction of a first form of implementation of the chronograph according to the invention; and FIG. 2 shows a schematic reproduction of a second form of implementation of the chronograph according to the invention.

In the drawings the same or equivalent parts are indicated with the same reference numbers. Not all parts that are necessary for a correct working of the chronograph are shown and described; only those parts necessary for understanding the invention are shown and described here.

FIG. 1 shows a chronograph 1 according to the first form of implementation of the invention. The chronograph 1 comprises a main dial 2 with centrally positioned main hands group, comprising a chrono second hand 3, a chrono hour hand 4 and a chrono minute hand 5. Within the main dial 2 a sub dial 6 is shown with a therein centrally positioned sub hands group, consisting of a current second hand 7, a current hour hand 8 and a current minute hand 9. In both cases the order of setup of the hands groups is second, hour and minute hand, at which the minute hand is situated nearest to the dial.

The main dial has a subdivision in six hours along its outline. Also along the outline a scale division of 60 units is provided, that serves for the chrono second hand as well as the chrono minute hand.

When the chrono timekeeping is not active, the chrono hands will all be pointing upwards, to the position indicated with 0 (zero). As a result, an obstruction free reading of the current time is possible. The central axis of the sub dial is within the circumference of the main dial and the central axis of the main hands family is at a distance larger than the length of the longest hand of the sub hands family. The length of the hands of the subhands family will be chosen such that they do not coincide with the the scale division of the main dial. The distal ends of the hands of the main dial will however extend beyond each of the hands of the subdial family when the distal end of such a subdial hand is at its shortest distance to the scale division of the main dial.

In the form of implementation as shown in FIG. 1 a second and third sub dial 10 respectively 11 are also provided. The second sub dial 10 has two hands 12, 13. The third sub dial 11 has two hands 14, 15. Sub dial 10 displays an alarm time by means of alarm hour hand 12 and alarm minute hand 13. The alarm time is adjustable by means of a control button 16. For example, it may be provided that by pressing and holding the button 16 (hereinafter also referred to with the term pusher) the alarm hands initially move forward slowly and after some time, for example after two seconds, move forward faster until the pusher is released. By briefly pressing the pusher 16 the alarm time can jump forward repeatedly with one minute. As a result an accurate adjustment of the alarm time is possible. Pressing down pusher 17, or simultaneously pressing pusher 16 and another control button, for example one of the pushers 17, 18 or 19, can switch on, respectively switch off the alarm. Yet another combination for example can reset the alarm as a result of which the hands all are placed on the 12-position. Through alarm indicator 21 it is indicated if the alarm is switched on or switched off.

The third sub dial 11 can display a second time, for example from another time zone. This time can be set by means of control button 18. For example, it may be provided that the third sub dial is only active as second time display when the chronograph is inactive.

If the chronograph is active a next automatic operation can be provided. Activating the chronograph can be obtained by pressing pusher 18. The chrono time then begins to run. Then the hands of the second sub dial 10 can automatically display and hold the then applicable current time. The starting time point of the current time at the time of activating the chronograph is then permanently displayed on the second sub dial. Also the third sub dial can then automatically display that time, but for example, run together with the current time. When the chronograph is set to pause, for example with pusher 18, the time display of the third sub dial 11 can be brought to stop, as a result of which the time of ending the chrono timekeeping is displayed on the third sub dial 11. A clear overview of the current time on sub dial 6, as well as the start time of the timekeeping on sub dial 10 and the end time of the timekeeping on sub dial 11 is then obtained, as well as the time kept on the main dial 2.

Resetting the chronograph can be done through pusher 19.

Furthermore in, FIG. 1 a winder 20 for setting the current time is displayed. At this it is important that the minute hand is positioned exactly on the index when the current second hand passes the index (the so-called 12 hour-position). A particularly inventive way of setting the current time is done as follows: by pulling out the winder completely the second hand jumps on the twelve and the current minute hand jumps on the nearest index. By pressing and holding pusher 18, the minute and hour hand begin to run with a first speed and then, after for example two seconds, run faster. After releasing pusher 18 the hands stop, at which the minute hand is always positioned on an index. By subsequently pressing pusher 18 once the minute hand moves one index position. As soon as the winder is pushed in completely the current time begins to run. In this revolutionary way the second and minute hand always stay in line.

It may be provided that pressing pusher 19 has a similar effect as pressing pusher 18, namely that the minute and hour hand initially begin to run with a first speed and then, by pressing and holding pusher 19, after for example two seconds, run faster, on the understanding that the hands move counterclockwise. Also it may provide the manual jumping of the hands with one index position at a time when the pusher is being pressed, also on the understanding that the hands move counterclockwise. This is particularly of advantage when, for instance, switching quickly from summer to wintertime. For example, only the hour hand can move back an index position.

FIG. 2 shows a variant of the chronograph 1 according to the invention. The chronograph 1 comprises a main dial 2 with centrally positioned main hands group, consisting of a chrono hour hand 4, a chrono minute hand 5 and a chrono second hand 3. In case of the chrono time the order of placing of the hands groups is hour, minute and second hand, at which the second hand is situated closest to the dial. Concentric within the main dial 2 a sub dial 6 is paced with a therein centrally placed sub hands group, consisting of a current second hand 7, a current hour hand 8 and a current minute hand 9. In case of the current time the order of placing of the hands groups is second, hour and minute hand, at which the minute hand is situated closest to the dial. The main dial 2 is provided with an along the outline fitted subdivision in six units, for displaying hours by means of chrono hour hand 4. A subdivision in sixty units is provided to indicate seconds by means of chrono second hand 3 and to indicate minutes by means of chrono minute hand 5. It is known in the art to drive hands at different speeds using hollow co-axial axles. For the manufacture of a chronograph, the subfamily dial 6 may be provided on a hollow, non-rotating (and even better fixedly connected via a bridge to the frame of the time piece) axle. The subfamily dial 6 may in fact be considered as a non-rotating hand. In other words, the chronograph as shown in FIG. 2 may be manufactured like any other time piece using a plurality of hollow, co-axial axles. For the present application, the term "within the circumference of the main dial" includes the projection of the sub dial onto the main dial, the projection being within said circumference.

A current time is displayed by sub dial 6 with the above described sub hands group. The activation of the chrono timekeeping can be done through pusher 18, that can also serve for pausing or stopping it. Resetting the chronograph can be done by means of pusher 19.

Switching from current mode to chrono mode can easily be done by pressing pusher 19, that can also serve as a reset button, as mentioned before.

Pusher 19 is used as reset button to put the chrono hands on zero. So it is active in one part of the chrono function. After the chrono hands have taken the zero position pressing pusher 19 once again serves to switch over from chrono function to current time function.

Another differentiation of the invention is one wherein the sub dial with sub hands group for display of the current time only comprises an hour hand and a minute hand. When the chronograph is not in use, the time is displayed in seconds by means of three collective chrono hands that rotate in a congruous way and collectively display the time in seconds. When the chrono mode is active (for instance by simultaneously pressing the opposite pushers 18 and 7 of FIG. 1), the display of the second time by the chrono hand ends which are all placed in the zero position.

Now the chrono hands group is ready to start (for example by pressing pusher 18). When the chrono timekeeping is ended and the chrono hands are placed back in the zero position with a reset-operation, by yet again simultaneously pressing pushers 18 and 7 a conversion to the current second time display is obtained. The collective chrono hands take the position where they would have been if no chrono timekeeping had been performed.

The invention is not limited to the above described and in the figures shown form of implementation. It is only limited by the following claims.

The invention claimed is:

1. Chronograph comprising:

a display face;

a main dial located within the display face, the main dial having a circumference and defining a main dial axis;

a main hands group positioned within the main dial, the main hands group comprising:

a chrono second hand;

a chrono minute hand; and a chrono hour hand;

each of the chrono second hand, the chrono minute hand and the chrono hour hand being controllably rotatable about the main dial axis to display chrono time;

at least one control for simultaneous activation of the chrono second hand, the chrono minute hand and the chrono hour hand for at least one function selected from starting, pausing, stopping and resetting of chrono timekeeping;

a first sub dial positioned within the display face and within the circumference of the main dial, the first sub dial having a smaller radius than the main dial; and a first sub hands group positioned within the first sub dial, wherein the first sub hands group comprises at least two hands which display current time while the main hands group displays chrono time.

2. Chronograph according to claim 1, wherein the first sub dial is positioned decentralized within the circumference of the main dial.

3. Chronograph according to claim 1, further comprising:

a second sub dial positioned within the display face and within the circumference of the main dial; and a second sub hands group positioned within the second sub dial.

4. Chronograph according to claim 3, wherein the second sub hands group is for displaying an alarm time.

5. Chronograph according to claim 4, wherein, when the main hands group is active for chrono timekeeping, the second sub dial displays a chrono time display of tenths or hundreds of a second.

6. Chronograph according to claim 3, wherein the second sub hands group is for displaying a second time.

7. Chronograph according to claim 6, wherein, when the main hands group is active for chrono timekeeping, the second sub dial displays a chrono time display of tenths or hundreds of a second.

8. Chronograph according to claim 1, wherein an order of placing of the main hands group is chrono second, chrono hour and chrono minute hand, with the chrono minute hand situated closest to the display face.

9. Chronograph according to claim 1, wherein the first sub dial is positioned in a position of the main dial lower than the main dial axis.

10. Chronograph according to claim 1, wherein the main dial comprises an hour scale divided in six hours per revolution, situated along its outline.

11. Chronograph according to claim 1, further comprising a control button for setting the current time.

12. Chronograph according to claim 1, wherein the control for simultaneous activation of the chrono second hand, the chrono minute hand and the chrono hour hand is a control button.

13. Chronograph according claim 1, further comprising at least one control button for at least one function selected from activation and setting of an alarm.

14. Chronograph according to claim 13, further comprising an indicator with a first indication for switched off alarm and second indication for switched on alarm.

15. Chronograph according to claim 1, wherein the first sub dial is placed coaxially within the main dial with the first sub hands group rotating about the main dial axis, and wherein the main hands group are partially covered by the first sub dial.

16. Chronograph according to claim 1, wherein the chronograph has a chrono mode which can be active or inactive, wherein the sub hands group for displaying the current time comprises only an hour hand and a minute hand, and while the chrono mode is inactive and the main hands group does not display chrono time at least one hand of the main hands group indicates the current second time.

* * * * *